United States Patent [19]

Mears

[11] Patent Number: 4,618,002

[45] Date of Patent: Oct. 21, 1986

[54] FIRE PROTECTION SPRINKLER HEAD

[75] Inventor: James W. Mears, Warwick, R.I.

[73] Assignee: Grinnel Corporation, Providence, R.I.

[21] Appl. No.: 820,877

[22] Filed: Jan. 16, 1986

Related U.S. Application Data

[63] Continuation of Ser. No. 589,224, Mar. 13, 1984, abandoned.

[51] Int. Cl.[4] ..... A62C 37/10

[52] U.S. Cl. ..... 169/37

[58] Field of Search ..... 169/19, 37–42, 169/DIG. 3; 137/72, 76; 251/337

[56] References Cited

U.S. PATENT DOCUMENTS

| | | | |
|---|---|---|---|
| 1,177,182 | 3/1916 | Hammond | 169/42 |
| 1,808,684 | 6/1931 | Rowley | 169/38 X |
| 1,919,508 | 7/1933 | Griffith | 169/42 |
| 2,389,331 | 11/1945 | Tyden | 169/37 |
| 2,389,332 | 11/1945 | Tyden | 169/37 |
| 2,732,018 | 1/1956 | Grimes | 169/39 |
| 3,195,647 | 7/1965 | Campbell et al. | 169/1 |
| 3,633,676 | 1/1972 | Gloeckler | 169/40 |
| 3,638,733 | 2/1972 | DeRouville et al. | 169/19 |
| 3,756,321 | 9/1973 | Gloeckler | 169/40 |
| 3,815,873 | 6/1974 | Hendrick | 251/337 |
| 3,874,456 | 4/1975 | Gloeckler | 169/39 |
| 4,015,665 | 4/1977 | Simons et al. | 169/40 |
| 4,105,076 | 8/1978 | Simons et al. | 169/40 |
| 4,228,859 | 10/1980 | Hattori | 169/40 X |
| 4,343,364 | 8/1982 | Glinecke | 169/38 |
| 4,465,141 | 8/1984 | Johnson | 169/37 |
| 4,491,182 | 1/1985 | Pieczykolan | 169/38 |

OTHER PUBLICATIONS

"Model 'H' ½ Inch Orifice Recessed Sprinkler", Central Sprinkler Corporation, Bulletin FR-H, Rev. No. 2, (12/81).

"Series 400 Fixed Temperature Fire Detector," Chemetron.

"Phantom". Grunau.

"Model A Flush Automatic Sprinkler", Reliable.

"Star Concealed Sprinkler", Star Sprinkler Corporation.

"Flush Sprinkler and Accessories", Viking.

*Primary Examiner*—Andres Kashnikow

[57] ABSTRACT

A fire protection sprinkler head of the automatic type including a latch for retaining a valve closure in standby position until a thermally responsive element releases the latch at a preset temperature to thereby release the closure to allow flow of fire-retarding fluid, the latch including a catch, typically in the form of a lip extending radially inwardly from the sprinkler body, a radially inwardly biased spring detent, and relatively separable, detent restraining elements. In the preferred embodiment, the sprinkler includes a deflector adapted to be retained and released by the latch, and the restraining elements are adapted to mutually define therebetween a generally circumferential groove for forcing a ring-form spring detent radially outward into engagement with the catch to secure the latch in standby position, and are further adapted to move relative to each other when the thermally responsive element reaches the preset temperature to permit the spring detent to relax radially inwardly to disengage from the catch whereby the latch is released from standby position.

11 Claims, 10 Drawing Figures

FIG 1
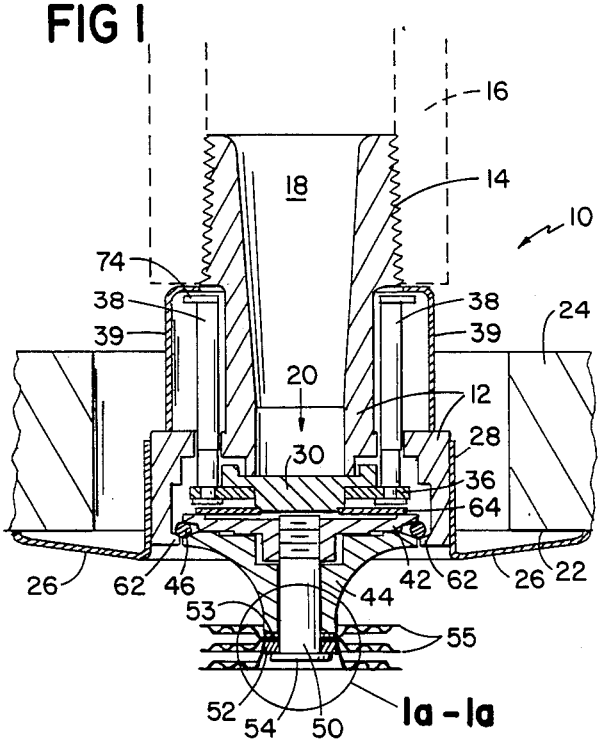
FIG Ia
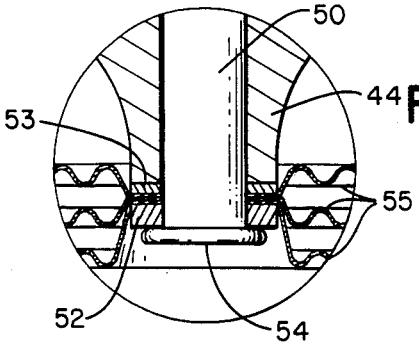
FIG 6
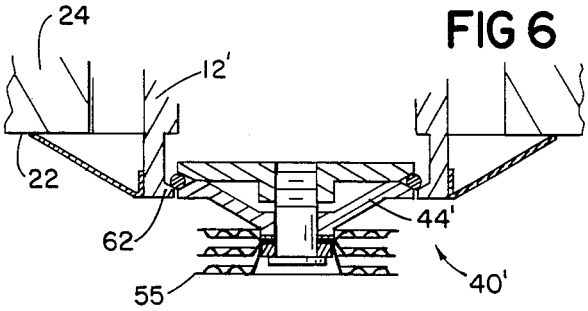
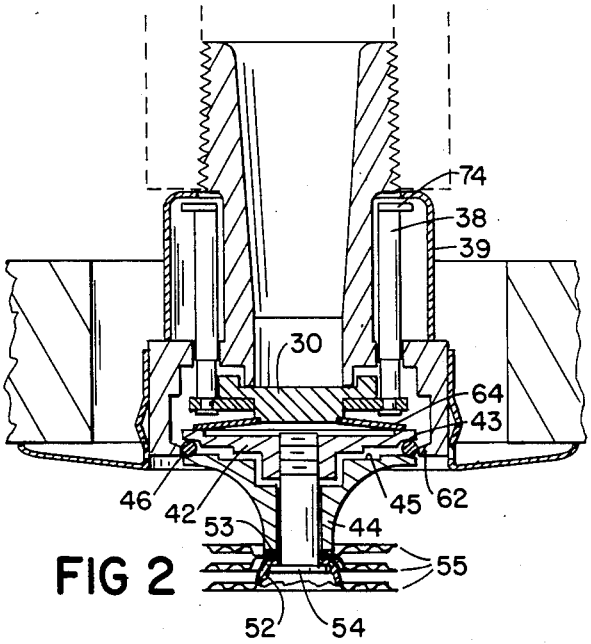
FIG 2
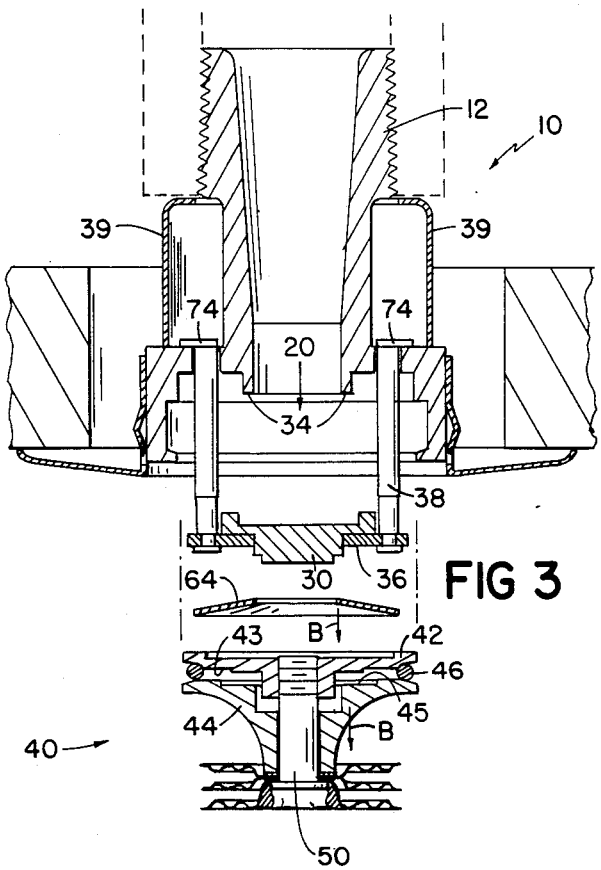
FIG 3

FIG 4
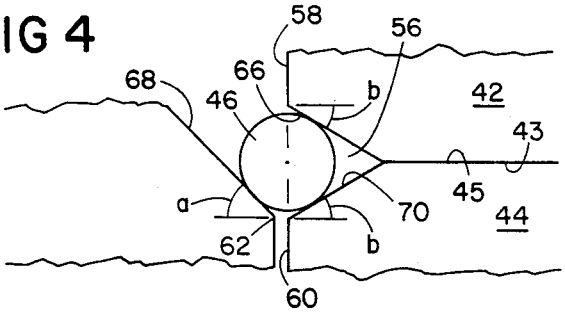
FIG 4a
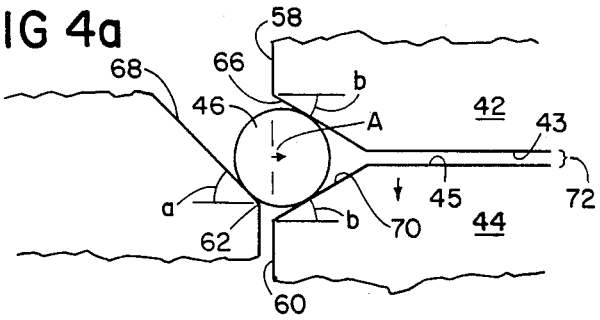
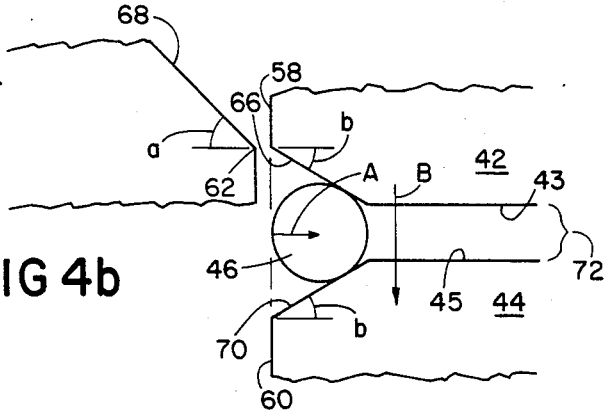
FIG 4b
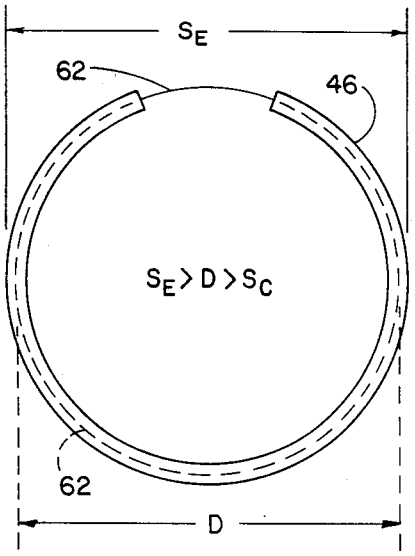
FIG 5
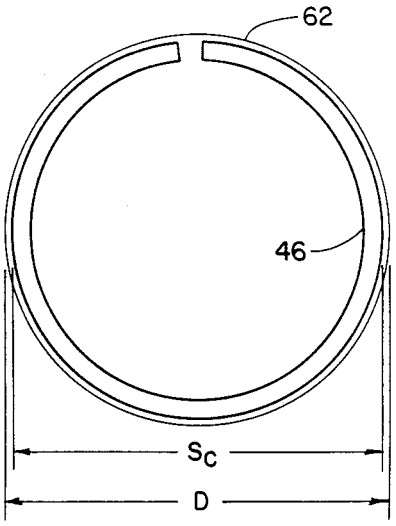
FIG 5a

FIRE PROTECTION SPRINKLER HEAD

This is a continuation of application Ser. No. 589,224, filed Mar. 13, 1984, now abandoned.

BACKGROUND OF THE INVENTION

The invention relates to automatic fire protection sprinkler heads.

As is well known, automatic fire protection sprinkler systems typically consist of a piping system extending throughout the building to be protected, with automatic sprinkler head outlets positioned along the piping in a configuration to help protect life and property in case of fire. Automatic sprinkler heads utilize a valve element which is normally maintained in a stand-by (closed) position by thermally responsive means, e.g., a fusible link, frangible bulb or other thermal element. When the surrounding air temperature causes the temperature of the thermal element to increase to its release temperature, the valve element is caused to open to release fire-retardant fluid, typically water.

In warehouses and other premises where aesthetic appearance is not a consideration, sprinkler heads are usually fully exposed. However, in applications such as offices, hotels and residences, it has often been desirable to arrange the fire protection sprinkler system piping above the ceiling and to employ pendent sprinkler heads which for the most part are hidden above the lower plane of the ceiling, or to arrange the piping behind the walls and to employ recessed sprinkler heads which are for the most part hidden behind the plane of the wall.

Two types of pendent sprinklers for ceiling applications are referred to by the terms "concealed" and "flush". A concealed sprinkler has its entire body, including the thermally responsive element which releases the valve, located above the lower plane of the ceiling and hidden from view by a concealing plate located just beneath the ceiling. Prior patents illustrating this type are Juliano U.S. Pat. No. 3,998,273; Anderson U.S. Pat. No. 4,066,129 and Mears U.S. Pat. No. 4,215,751.

A flush sprinkler head has the majority of its body located above the lower plane of the ceiling while the thermally responsive element is located below the ceiling. Prior patents illustrating this type are Winslow U.S. Pat. No. 2,271,399; Tyden U.S. Pat. Nos. 2,389,331 and 2,389,332; Campbell et al. U.S. Pat. No. 3,195,647 and Miyazaki U.S. Pat. No. 4,217,960.

The concealed sprinkler head is less obtrusive and generally regarded as more attractive than the flush sprinkler head. Unfortunately, the temperature of its thermally responsive element rises more slowly when heated air currents occur, and therefore it has a relatively lower speed of response.

For sidewall sprinkler heads there is a similar need for a construction that enables good appearance and fast response to be achieved.

It is the object of this invention to provide an automatic sprinkler head which enables good appearance and quick response, and is at the same time reliable and practical to produce. A further object is to provide an improved sprinkler head construction which is more generally useful in other types of sprinklers.

SUMMARY OF THE INVENTION

The invention relates to a fire protection sprinkler head of the automatic type comprising a body with means for connecting the head to a supply of fire retardant fluid, a passage through the body for the fluid, a closure means for sealing the passage, a latch means for retaining the closure means in a standby position wherein the passage is sealed by the closure means, and a thermally responsive means adapted to release the latch means from the standby position at a preset temperature to thereby release the closure means to allow flow of fluid from the passage.

According to the invention, the latch means comprises a catch in the form of a lip extending radially inwardly from the body, a radially inwardly biased spring detent means, and relatively separable, detent restraining elements, the restraining elements being adapted to mutually act to force the spring detent means radially outward into engagement with the catch to secure the latch means in the standby position, and the restraining elements being further adapted to move relative to each other when the thermally responsive means reaches the preset temperature to thereby permit the spring detent means to relax radially inwardly to disengage from the catch whereby the latch means is released from the standby position.

In preferred embodiments, a spray-distributing deflector is positioned outside of the passage and in the path of fluid emerging from the passage, the deflector being adapted to be retained by the latch means in the standby position and being further adapted to be released by the latch means at the preset temperature, and guide members are fastened to the deflector and slidably mounted in the body, the guide members having provision for stopping the movement of the deflector at a predetermined distance away from the passage and the standby position; the force applied by the fire-retardant fluid to the closure means in the standby position is opposed by the latch means which is adapted to isolate the thermally responsive means from a substantial portion of the force; the restraining elements cooperate to define a circumferential groove adapted to maintain a detent spring in latching position, and, by their relative movement during actuation, the restraining elements are adapted to deepen the groove to accommodate radial relaxation of the spring detent means; the spring detent means is generally toroidal in shape; the thermally responsive means comprises a fusible medium positioned, when it melts, to release one of the restraining elements; the sprinkler head has at least one heat conductive fin element disposed in heat conductive relationship with the thermally responsive means, the fin element being arranged in a manner, relative to the sprinkler body, to absorb heat from air currents moving in the area to be protected against fire; the restraining elements are arranged coaxially, and the response of the thermally responsive means to the preset temperature allows a first restraining element to move along the axis relative to a second restraining element to release the latch; the spring detent means and the restraining element are adapted to fall away from the head when the latch is released from the standby position; and the thermally responsive means is disposed at a position spaced below the ceiling plane.

In another aspect, the invention features a sprinkler head which includes a member which, when allowed to move away from the passage, releases a latch, and a thermally responsive means serves to maintain the member in the standby, latching position.

According to this aspect of the invention, the thermally responsive means comprise a thermally conductive fin means of circular form and an annular mass of fusible solid held in position by a post extending from an outer retaining head, through the fusible solid, the circular fin and the member of the latch to a point of fixation, the head holding the fusible mass under compression against a hub portion of the fin means in face-to-face contact, serving to maintain the member in the standby position, and the member being slidable upon the post whereby heat absorbed by the fin means from surrounding air, conducted inwardly to the hub region of the fin means, thence axially to the fusible solid, causes the solid to fuse and flow away, permitting the member to move away from the passage and release the latch.

PREFERRED EMBODIMENT

We first briefly describe the drawings.

DRAWINGS

FIG. 1 is a side section view of one embodiment of a pendent sprinkler head according to the invention in its standby (closed) condition;

FIG. 1*a* is an enlarged view showing interengagement of heat conductive fins between the fusible element and the insulative ring;

FIG. 2 and FIG. 3 are views of the sprinkler head of FIG. 1 showing sequentially the response to the presence of temperature above a preselected maximum;

FIGS. 4, 4*a* and 4*b* are enlarged diagrammatic views showing the relationship of the spring detent to adjacent surfaces in FIGS. 1, 2 and 3, respectively;

FIGS. 5 and 5*a* are diagrammatic plan views of the spring detent and lip of FIG. 4 and FIG. 4*b*, respectively; and FIG. 6 is a side section view of another embodiment of a sprinkler head according to the invention.

Referring to FIG. 1, automatic sprinkler head 10 comprises a body or frame 12 having external threads 14 for connection to internally threaded outlet 16 from a fire protection water supply line. Body 12 defines a passageway 18 for water from line outlet 16 to sprinkler outlet 20.

Head 10 lies primarily above the lower surface 22 of ceiling 24. An annular skirt 26 affixed about body 12 bridges the gap between the head and the surrounding ceiling surface. To provide proper contact with the ceiling surface, skirt 26 is adjustable vertically by sliding of its inner sleeve 28 relative to body 12.

Disposed across sprinkler outlet 20 is plug 30, typically brass with a polyfluoroethylene (e.g., DuPont's TEFLON) coating on the upper surface to provide proper sealing on seat 34. Deflector plate 36, lying below plug 30, has support arms 38 which slide down into deflector-supporting position when the sprinkler is activated, as described below. Shield 39 protects the arms 38 against interference with this sliding movement.

Plug 30 is held in sealing contact by dome spring 64 and control assembly 40 which holds spring 64 under upward compression. Control assembly 40 comprises upper and lower restraining elements 42, 44 which define an annular peripheral groove 56 (FIG. 4) and, disposed in this groove, a radially inwardly biased annular detent spring 46. Detent spring 46, also shown in plan view in FIG. 5, typically is of phosphor bronze or inconel wire with a diameter of 0.060 inch, formed into a split annulus or torus having relaxed diameter of about 1 inch. In tensioned state, FIGS. 1 and 5, the spring 46 is expanded, e.g., by about 6 percent.

Restraining elements 42, 44 are connected coaxially by screw 50 which extends from its head 54 freely through lower element 44 and is threaded into upper element 42. There is a space between head 54 and the lower end of element 44 which, during releasing action (FIGS. 2, 3), enables this lower element 44 to move axially away from upper element 42 along the shaft of screw 50. However when the restraining elements 42, 44 are in the standby closing condition shown in FIG. 1, this space is filled by fusible element 52, of annular construction, which is held in position by screw head 54. The restraining elements and the fusible element are sized so that when screw 50 is tightened during assembly, the end surfaces 43, 45 (FIGS. 2 and 4) of the upper and lower restraining elements are in contact and the fusible element 52 is under slight compression, e.g., 15 to 20 pounds, that aids its flow during melting, as described below, but does not cause any significant degree of cold creep. Heat conductive fins 55 lie below ceiling surface 22 for exposure to the air currents in the area to be protected and have central portions in face-to-face heat conductive relationship with the end surface of fusible element 52. As shown in FIG. 1*a*, insulative element 53, below the lower restraining element 44 but above the central portion of the fins and the space filled by fusible material 52, provides a thermal barrier between heat conductive fins 55 and the rest of the assembly.

Referring to FIG. 4, to define groove 56, adjacent opposed surfaces 66, 70 of the periphery of restraining elements 42, 44 lie at angle, b, of approximately 25 degrees above and below the horizontal, respectively. This groove is of diameter suitable to hold detent spring 46 expanded under tension and is of diameter suitable to hold the body of the spring in a radially extended position of diameter $S_E$ outwardly beyond the peripheral edges 58, 60 of the restraining elements. This extended portion of detent spring 46 engages upon inwardly, downwardly sloped surface 68 of retaining lip 62 (FIG. 5) of sprinkler body 12, surface 68 lying at an angle, a, of approximately 40 degrees to the horizontal, and lip 62 having a diameter, D. This construction substantially isolates the fusible element, typically solder, from the opposed forces of dome spring 64 and of the fluid in the supply system, and reduces the likelihood of cold creep the fusible element under load of these forces which could cause leaking or sprinkler malfunction.

Referring now to FIGS. 2 and 4*a*, heat carried by the air currents in the area protected is absorbed by exposed fins 55 and conducted to fusible element 52. When the fusible element reaches a preselected temperature it melts and flows from the space between the screw head 54 and heat conductive fins 55, below the insulative ring 53 and the lower restraining element 44. This flow is facilitated by the slight compression applied to tighten screw 50. When element 52 melts, element 44 moves downward, indicated by arrow, B, from upper element 42 as the result of camming action of spring 46: the contractive force of expanded spring 46 acts inwardly against the inwardly, downwardly sloped surface 70 of lower element 44. As lower element 44 moves down and the gap 72 between opposed surfaces 43, 45 is opened, spring 46 radially contracts (arrow, A) into the gap, as its spring tension is relieved.

A point is reached in this contraction (FIGS. 2, 4*b* and 5*a*) when the outer diameter $S_C$ of annular detent spring 46 becomes smaller than the constant diameter, D, of the circular opening defined by the retaining lip 62 of the body 12. The detent spring then moves outwardly through this opening under the influence of the spring force of compressed dome spring 64. Thus, as shown in FIG. 3, the entire control assembly 40 and dome spring 64 are released and move away from sprinkler head 10.

At this point plug 30 is no longer urged against the outlet. The force of water from outlet 20 against the opposed surface of the plug urges deflector 36 downward, its arms 38 sliding relative to body 12 until their stops 74 rest against ledges provided by the body. This positions the deflector below the outlet, at a distance predetermined for proper deflection and dispersion of the flow of water, to cover the desired area to be protected.

OTHER EMBODIMENTS

Other embodiments are within certain of the following claims. For one example, in FIG. 6 sprinkler body or frame 12' extends a greater distance below the surface 22 of ceiling 24. In this case, the vertical height of lower restraining element 44' is decreased and the distance of the heat conductive fins 55 below the ceiling surface may be the same as described above.

As another example, a sidewall sprinkler employing the invention may be adapted for use with a horizontal orientation of the body. The sprinkler in this orientation would typically have a first deflector portion disposed in front of the outlet perpendicular to the direction of flow, as employed in the pendant sprinklers shown, but would also have a second deflector portion parallel to and slightly above the flow from the outlet in a position to deflect flow away from the ceiling down onto the protected area for maximum effectiveness of the available flow.

What is claimed is:

1. In a fire protection sprinkler head of the automatic type comprising a body with means for connecting said head to a supply of fire retardant fluid, a passage through siad body for said fluid, a closure means for sealing said passage, a latch means for retaining said closure means in a standby position wherein said passage is sealed by said closure means, and a thermally responsive means adapted to release said latch means from said standby position at a preset temperature to thereby release said closure means to allow flow of fluid from said passage, the improvement wherein said latch means comprises a catch in the form of a lip disposed generally radially inwardly from said body and having a surface sloped inwardly from said body toward said lip, a radially inwardly biased spring detent means, and first and second relatively separable, detent restraining elements, arranged on a common axis, said restraining elements cooperatively defining a circumferential generally V-shaped groove sized and adapted to receive said spring detent means and being further adapted to mutually act to force said spring detent means radially outward into engagement with the inwardly sloped surface of said catch to secure and maintain said latch means in said standby position, and said first restraining element being adapted to move along said axis relative to said second restraining element to deepen said groove when the thermally responsive means reaches said preset temperature to thereby permit and accommodate said spring detent means to relax radially inwardly along said inwardly sloped surface, toward said lip, and to disengage from said catch whereby said latch means is released from said standby position.

2. The fire protection sprinkler head of claim 1 wherein said sloped surface lies at an acute angle of the order of about 40° to said axis.

3. The fire protection sprinkler head of claim 1 further comprising a spray-distributing deflector positioned outside of said passage and in the path of fluid emerging from said passage, said deflector adapted to be retained by said latch means in said standby position and being further adapted to be released by said latch means at said preset temperature, and guide members fastened to said deflector and slidably mounted in said body, said guide members having provision for stopping the movement of the deflector at a predetermined distance away from said passage and said standby position.

4. The fire protection sprinkler head of claim 1 wherein the force applied by said fire-retardant fluid to said closure means in standby position is opposed by said latch means, said latch means being adapted to isolate said thermally responsive means from a substantial portion of said force.

5. The fire protection sprinkler head of claim 1 wherein said spring detent means is generally toroidal in shape.

6. The fire protection sprinkler head of claim 1 wherein said thermally responsive means comprises a fusible medium positioned, when it melts, to release one of said restaining elements.

7. The fire protection sprinkler head of claim 6 having at least one heat conductive fin element disposed in heat conductive relationship with said thermally responsive means, said fin element being arranged in a manner, relative to said sprinkler body, to absorb heat from air currents moving in the area to be protected against fire.

8. The fire protection sprinkler head of claim 1 wherein said spring detent means and said restaining elements are adapted to fall away from said head when said latch means is released from said standby position.

9. The fire protection sprinkler head of claim 1 in the form of a pendant, flush sprinkler head wherein said thermally responsive means is disposed at a position spaced below the ceiling plane.

10. In a fire protection sprinkler head of the automatic type comprising a body with means for connecting said sprinkler head to a supply of fire retardant fluid, a passage through said body for said fluid, a closure means for sealing said passage, a latch means for retaining said closure means in a standby positioned wherein said passage is sealed by said closure means, and a thermally responsive means adapted to release said latch means from said standby position at a preset temperature to thereby release said closure means to allow flow of fluid from said passage, said latch means including a member which, when allowed to move away from said passage, releases said latch means, and said thermally responsive means serving to maintain said member in said standby position;

the improvement wherein said thermally responsive means comprises thermally conductive fin means of circular form and an annular mass of fusible solid held in position by a post extending from an outer retaining head, through said fusible solid mass, said fin means and said member of said latch means to a point of fixation, said retaining head holding said fusible mass under compression against surfaces of a hub portion of said fin means in face-to-face contact, and serving to maintain said member in said standby position, and said member being slidable upon said post whereby heat absorbed by said fin means from surrounding air, conducted inwardly to the hub region of said fin means, thence axially to said fusible solid mass, causes said solid mass to fuse and flow away, permitting said member to move away from said passage and release said latch means.

11. The fire protection sprinkler head of claim 10 further comprising a spray-distributing deflector positioned outside of said passage and in the path of fluid emerging from said passage, said deflector adapted to be retained by said latch means in said standby position and being further adapted to be released by said latch means at said preset temperature, and guide members fastened to said deflector and slidably mounted in said body, said guide members having provision for stopping the movement of the deflector at a predetermined distance away from said passage and said standby position.

* * * * *